US008925731B2

(12) United States Patent
Riedel et al.

(10) Patent No.: US 8,925,731 B2
(45) Date of Patent: Jan. 6, 2015

(54) UNBALANCED DRIVE FOR SCREENING MACHINES

(75) Inventors: Dietmar Riedel, Calgary (CA); Siegbert Surrey, Mettmann (DE); Detlef Papajewski, Bochum (DE)

(73) Assignee: ThyssenKrupp Industrial Solutions AG, Essen (DE)

( * ) Notice: Subject to any disclaimer, the term of this patent is extended or adjusted under 35 U.S.C. 154(b) by 1199 days.

(21) Appl. No.: 12/667,912

(22) PCT Filed: Jul. 17, 2008

(86) PCT No.: PCT/EP2008/005825

§ 371 (c)(1),
(2), (4) Date: May 28, 2010

(87) PCT Pub. No.: WO2009/012922

PCT Pub. Date: Jan. 29, 2009

(65) Prior Publication Data

US 2010/0243541 A1 Sep. 30, 2010

(30) Foreign Application Priority Data

Jul. 24, 2007 (DE) ..... 10 2007 034 512

(51) Int. Cl.
*B07B 1/28* (2006.01)
*F25B 39/02* (2006.01)
*F28F 1/22* (2006.01)

(52) U.S. Cl.
CPC . *F25B 39/02* (2013.01); *F28F 1/22* (2013.01); *F28F 2275/122* (2013.01)
USPC ..... 209/317; 209/315; 209/319; 209/364

(58) Field of Classification Search
USPC ..... 209/315, 317, 319, 364; 310/81
See application file for complete search history.

(56) References Cited

U.S. PATENT DOCUMENTS 5,037,536 A * 8/1991 Koch et al. ..... 209/325
5,683,586 A * 11/1997 Harcourt et al. ..... 210/695

(Continued)

FOREIGN PATENT DOCUMENTS

DE 78 11 967 U1 8/1978
DE 34 10 449 Al 9/1985

(Continued)

OTHER PUBLICATIONS

ThyssenKrupp Foerdertechnik, "Linear Vibrating Screens", pp. 1-12, Printed in Germany. Screens LSS 01 D 08.02, Aug. 2002.

*Primary Examiner* — Terrell Matthews
(74) *Attorney, Agent, or Firm* — McGlew and Tuttle, P.C.

(57) ABSTRACT

A drive device is provided for a screening body of a screening machine, in particular for mineral materials for crushing, such as oil sand, with a drive motor, a synchronous transmission gear which is operatively connected thereto and has at least two output shafts which rotate in pairs in antiphase at the same rotation speed with respect to one another. The drive motor and the synchronous transmission gear are mounted in a stationary manner, separately from the screening body, at the side alongside the screening body, and do not oscillate therewith. Each output shaft has a single associated horizontal shaft which has unbalance elements, and which is connected to the output shaft by means of a rotationally rigid universally jointed shaft and is arranged with its axis parallel to the adjacent shaft and transversely with respect to the conveying direction of the screening body. The unbalance elements are arranged in the horizontal direction between the side walls of the screening body, the shaft is supported by bearing elements on a cross member which is connected to the side walls, the unbalance elements are arranged exclusively directly on the shafts, the bearing elements are arranged exclusively on the shafts in the axial direction of the shafts between the unbalance elements, and the bearing elements are supported on a cross member which is connected to the side walls.

15 Claims, 3 Drawing Sheets

(56) References Cited

U.S. PATENT DOCUMENTS 6,155,428 A * 12/2000 Bailey et al. ..... 209/315
8,312,995 B2 * 11/2012 Dufilho et al. ..... 209/315

FOREIGN PATENT DOCUMENTS

EP 0 405 477 Al 1/1991
EP 0 692 317 1/1996

* cited by examiner

Fig 5
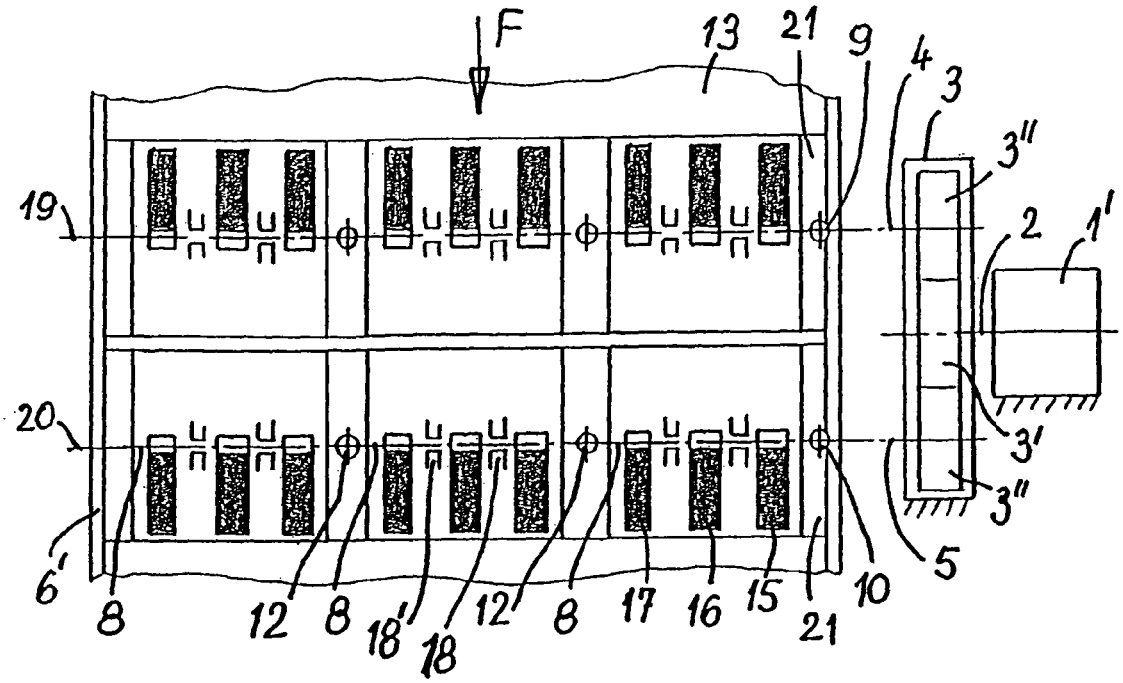
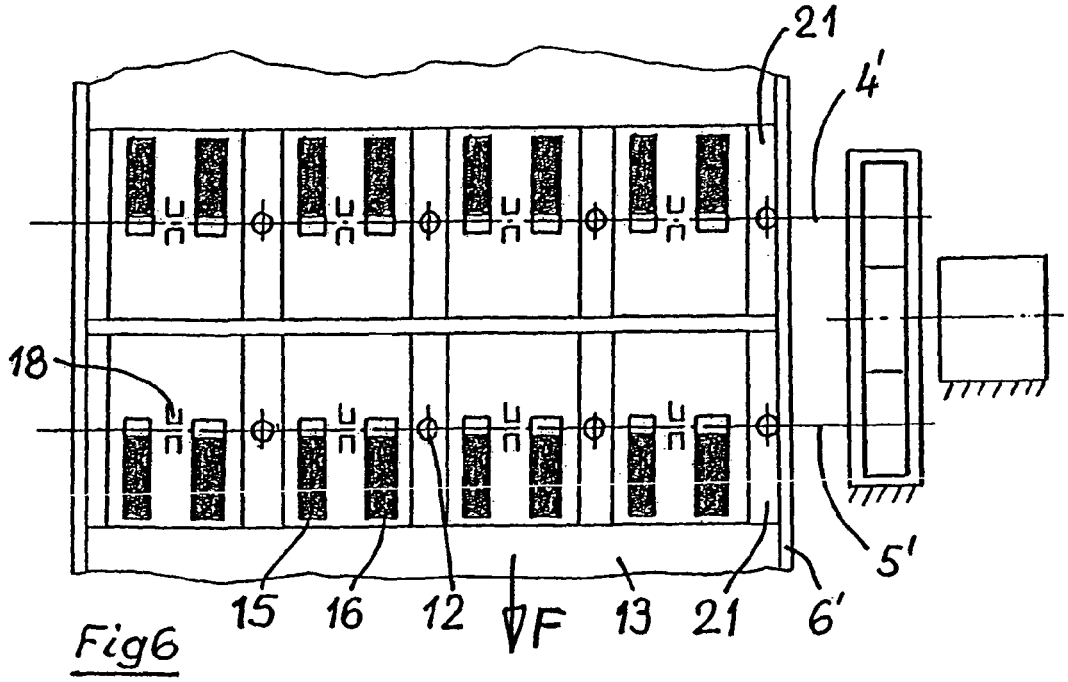
Fig6

UNBALANCED DRIVE FOR SCREENING MACHINES

CROSS REFERENCE TO RELATED APPLICATIONS

This application is a United States National Phase application of International Application PCT/EP2008/005825 and claims the benefit of priority under 35 U.S.C. §119 of German Patent Application DE 10 2007 034 512.9 filed Jul. 24, 2007, the entire contents of which are incorporated herein by reference.

FIELD OF THE INVENTION

The invention relates to a device for driving a screening machine comprised of at least one screening body.

BACKGROUND OF THE INVENTION

DE 7811967 UI discloses a drive generating oscillations for processing machines, e.g. an elliptic vibratory screen, to generate real elliptic oscillations, said drive comprised of two circular oscillation exciters generating these oscillations, as well as comprised of different unbalanced weights circulating at the same speed synchronously and in opposite direction. The unbalanced weights are arranged on two through shafts, with a transmission gear being provided in stationary arrangement next to the oscillating part of the machine, e.g. the screen box. The shafts of the unbalanced weights are connected to each other through universally jointed shafts or comparable parts with the transmission gear outlets. The through shafts carrying the unbalanced weights are configured as rigid shafts or universally jointed shafts.

A drive unit attributable to the applicant is comprised of an unbalanced drive to generate linear oscillations of large-size mechanical screens, with the oscillations being excited by so-called double-type unbalanced transmission gears. A transmission gear of this type is comprised of two shafts with unbalanced disks provided thereon, said shafts supported in axis parallel arrangement in a casing and whose oppositely directed movement of rotation is synchronized by a pair of cog wheels within the casing. The unit forms an unbalanced module. One of the two shafts protrudes on both sides from the casing, it is unilaterally driven and via the other shaft end it can drive another unbalanced module of this kind. To achieve a sufficient oscillation rate, this drive unit is comprised of six unbalanced modules mounted on the screen body. These are arranged on cross members in two axis parallel groups. The drive is effected by a non-oscillating stationary unit comprised of an electric motor and a powerful synchronization transmission gear located next to the screen machine. It requires relatively large space on the screen machine and owing to the additional synchronous cog wheels existing in them, as well as due to the oil greasing and the necessarily massively built transmission gear casings, there is an unnecessarily high "dead" mass of the unbalanced modules that oscillates, too.

SUMMARY OF THE INVENTION

Now, starting out from this prior art in technology, it is the object of the present invention to provide an unbalanced drive for a screen body of a screen machine with a high throughput capacity that does not have these drawbacks, but whose mass oscillating together with the screen body exceeds the sum of its unbalanced masses as little as possible and whose unbalanced mass can be varied and altered in modules.

This task is solved by a device for driving a screen body of a screen machine, said device comprised of a drive motor, a synchronous transmission which is operatively connected thereto and has at least two output shafts which rotate in pairs in antiphase at the same rotation speed with respect to one another, wherein the drive motor and the synchronous transmission are mounted in a stationary manner, separately from the screening body, at the side alongside the screening body, and do not oscillate therewith, and wherein each output shaft has a single associated horizontal shaft which has unbalance elements, and which is connected to the output shaft by means of a rotationally rigid universally jointed shaft and is arranged with its axis parallel to the adjacent shaft and transversely with respect to the conveying direction of the screening body, and wherein the unbalance elements are arranged in the horizontal direction between the side walls of the screening body, the shaft is supported by means of bearing elements on a cross member which is connected to the side walls, the unbalance elements are arranged exclusively directly on the shafts, bearing elements are arranged exclusively on the shafts in the axial direction of the shafts between the unbalance elements, and the bearing elements are supported on a cross member which is connected to the side walls.

In an advantageous manner, groups of unbalance elements including their bearings are combined to form unbalance modules. Each of these unbalance modules may be surrounded by a casing and it may also include the associated shaft section. It is also conceivable to provide only parts of the unbalance and bearing elements within a casing.

Individual unbalance modules are so spaced to each other that they can be brought into an operative connection with each other via short-built rotationally rigid offset clutches to offset assembly tolerances. In their status as built in, a through shaft is thus formed between the synchronous transmission gear and the individual unbalance elements.

In particular, the invention relates to the generation of linear oscillations of the screen body, though it is not restricted to it.

It is also conceivable to provide several drive units on one screen body as well as to provide several screen bodies with the appropriate drive within a screen machine.

The inventive object is illustrated and outlined based on an example of an embodiment in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 5 is a schematic view showing the set-up of a configured bearing area including the inventive idea; and FIG. 6 is a schematic view showing the set-up of a differently configured bearing area including the inventive idea.

DESCRIPTION OF THE PREFERRED EMBODIMENTS

Figures 1, 2:
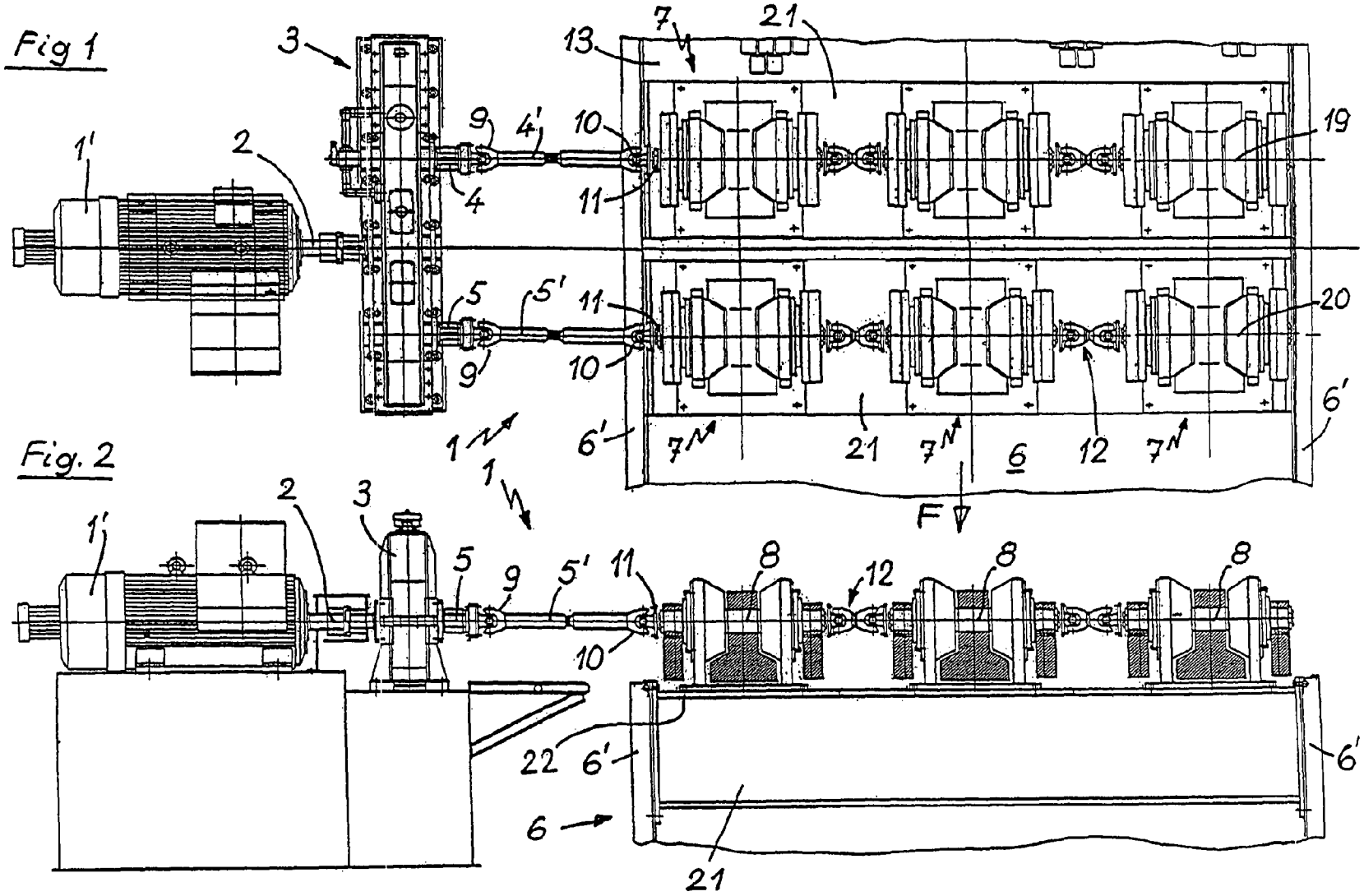
FIG. 1 is a top view showing a constructive set-up of the unbalanced drive according to the invention.
FIG. 2 is a top view showing a constructive set-up of the unbalanced drive according to the invention.

Referring to the drawings in particular, FIGS. 1 and 2 show principle views of a screen machine 1. Screen machine 1 is driven via a drive motor 1' which is linked via a drive shaft 2 to a synchronous transmission gear 3. Synchronous transmission gear 3 is comprised of two axis parallel output shafts 4, 5. Screen machine 1 is shown in part only and includes a screen body 6 which has indicatively shown side walls 6'. Between the side walls 6' of screen body 6, there are several unbalance modules 7 which are provided in exchangeable arrangement in the area of cross members 21 between side walls 6' of screen body 6. Shaft section 8 arranged in roughly axis parallel alignment like the corresponding output shaft 4, 5 of the synchronous transmission gear 3 extend in the area of the relevant cross member 21. Via rotationally rigid universally jointed shafts 4', 5' configured as universal joints and provided with cross joints 9, 10 in their end areas, the relevant output shaft 4, 5 of the synchronous transmission gear 3 is connected to the first unbalance module 7. Accordingly, the cross joint 10 engages at the end area 11 of the first shaft section 8. The individual shaft sections 8 are connected to each other via rotationally rigid offset clutches 12. The actual screen is indicated by reference mark 13.

Figure 4:
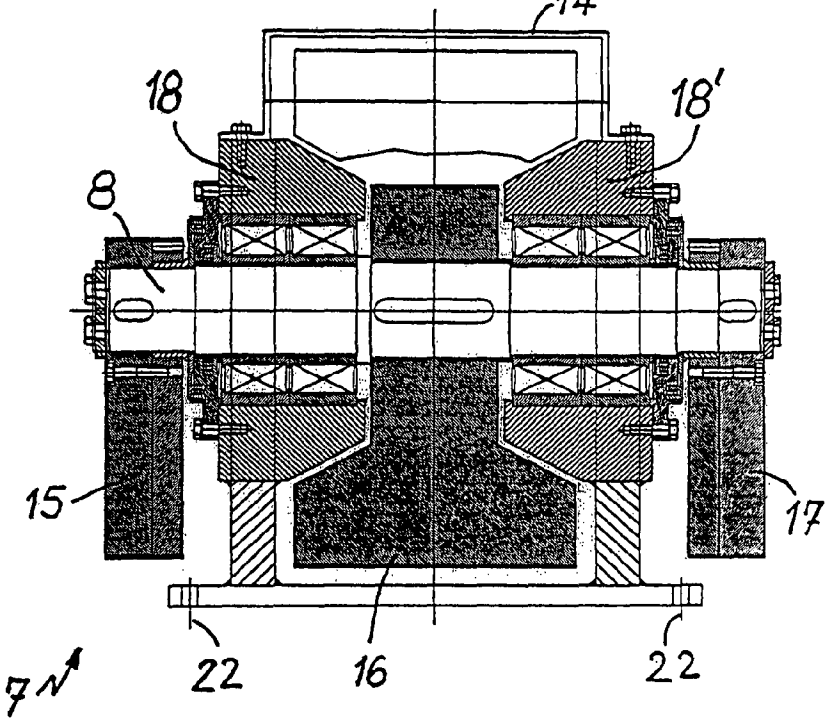
FIG. 4. is a sectional view of the unbalance module shown in FIG. 3.
Figure 3:
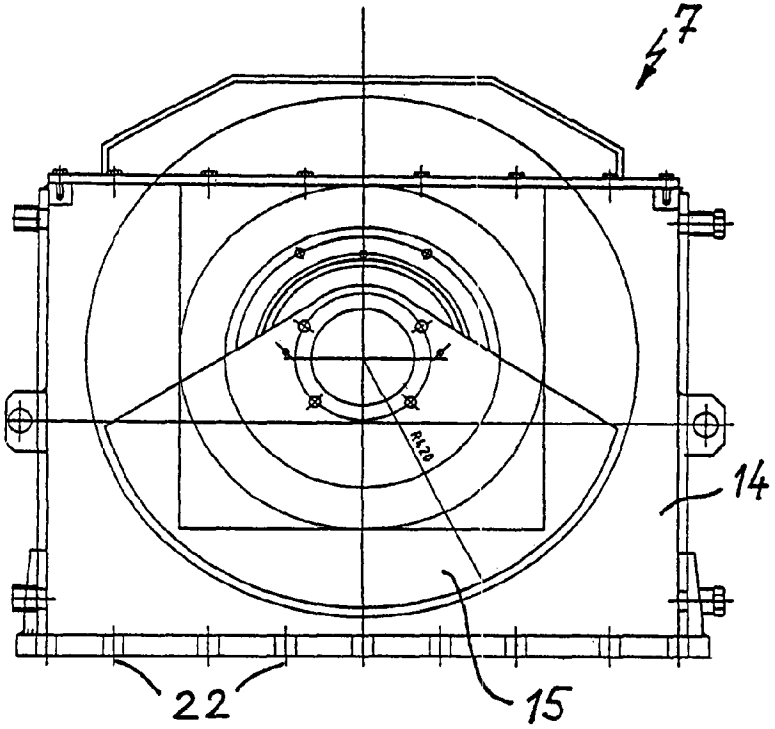
FIG. 3. is an end view of an unbalance module.

FIGS. 3 and 4 show a single unbalanced module 7 in different views. Illustrated is a casing 14 that surrounds part of the unbalance module 7. Each unbalance module is comprised of three spaced unbalance elements 15, 16, 17 fastened on a shaft section 8.

Bearing elements 18, 18' are positioned between the individual unbalance elements 15, 16, 17. In this example, the unbalance elements 15, 17 are arranged outside the casing 14. Each unbalance module 7 is comprised of fastening areas 22 through which it can be fastened to the relevant cross member 21 in the corresponding area (see FIG. 2).

FIGS. 5 and 6 again show the schematic set-up and/or function of the inventive unbalance drive. Indicatively shown is the screen machine 1, drive motor 1', drive shaft 2 of drive motor 1" the synchronous transmission gear 3 as well as its axis parallel output shafts 4, 5. In the area of screen machine 1, one can see the side walls 6', cross members 21 as well as unbalance modules 7, each of which being provided on a shaft section 8. Furthermore, one can see the joints 9, 10 provided at the first unbalance module 7 as well as the rotationally rigid offset clutches 12 arranged between the unbalance modules 7.

The difference between FIGS. 5 and 6 lies in that with FIG. 5 there are three unbalance elements 15, 16, 17 implemented per unbalance module 7, whereas with FIG. 6 there are merely provided two unbalance elements 15, 16. This necessitates a different configuration of the bearings. While there are two bearing elements 18, 18' provided for in FIG. 5, only a single bearing element 18 is implemented according to FIG. 6.

Advantages and benefits of the inventive unbalanced drive:

As compared with the represented prior art in technology, the internal synchronization transmission gears (pairs of cog wheels) contained in double-type unbalanced transmission gear modules as well as their secondary shafts are entirely omitted. Likewise omitted are the lubricating systems required for them. Moreover, the transmission gear casings are substantially less costly, because there is no need for exact cog wheel bearings and no need for a lubricating system as well as no need for casing seals and gaskets. Consequently, with the same "active" unbalanced mass, the demand for space, the overall weight, the co-oscillating "dead mass" and the price for the inventive unbalance modules 7 are much less than for prior art configurations.

The reduced demand for space (with identical outer dimensions) allows for adapting noticeably higher "active" unbalance masses and noticeably less co-oscillating "dead mass". This permits implementing alternatively longer screen bottoms, achieving higher throughput rates and/or smaller screen machines with the same throughput rate, respectively. This reduces the cost involved and by minimizing the overall weight and outer dimensions it allows for road transportation of screen machines having a higher throughput rate than hitherto.

The modular adaptability of the unbalance mass to the class of sizes and performance rates of screen machines can be accomplished in a more finely graduated manner. The inventive facility is readily applicable to conveyor chutes, vibratory conveyors, shaker conveyor chutes or similar facilities.

While a specific embodiment of the invention has been described in detail to illustrate the application of the principles of the invention, it will be understood that the invention may be embodied otherwise without departing from such principles.

The invention claimed is:

1. A drive device for a screening body of a screening machine for mineral materials for crushing, such as oil sand, the drive device comprising:

a drive motor;

a synchronous transmission operatively connected to said drive motor, said synchronous transmission having at least two output shafts which rotate in pairs in antiphase at the same rotation speed with respect to one another, wherein the drive motor and the synchronous transmission are mounted in a stationary manner, separately from the screening body, at a side alongside the screening body, and do not oscillate therewith;

a single horizontal shaft associated with each output shaft which has unbalance elements;

a rotationally rigid universally jointed shaft connecting each single horizontal shaft to the respective output shaft, each single horizontal shaft being arranged with an axis parallel to the adjacent horizontal shaft and transversely with respect to the conveying direction of the screening body, and wherein the unbalance elements are arranged in the horizontal direction between side walls of the screening body;

a cross member connected to the side walls of the screening body;

bearing elements, each horizontal shaft being supported by the bearing elements on the cross member, wherein the unbalance elements are arranged exclusively directly on the horizontal shafts, the bearing elements are arranged exclusively on the horizontal shafts in the axial direction of the shafts between the unbalance elements, and the bearing elements are supported on the cross member which is connected to the side walls, each horizontal shaft being formed of shaft sections arranged in alternating succession one behind the other and of offset clutches connecting said shaft sections in a rotationally rigid manner and mainly being flush to each other, wherein one shaft section together with the unbalance elements and the bearing elements arranged at said one shaft section forms an unbalance module.

2. A device according to claim 1, wherein the unbalance elements are individually arranged at the shaft sections.

3. A device according to claim 1, wherein several unbalance elements are arranged at one shaft section.

4. A device according to claim 1, wherein the shaft sections of one shaft each are jointly supported by means of bearing elements on one cross member.

5. A device according to claim 1, wherein an unbalance module is partly or entirely surrounded by a casing.

6. A device according to claim 1, wherein the unbalance modules are fixed in exchangeable arrangement at the cross members carrying them.

7. A device according to claim 1, wherein the cross members in the upper area of the screening body transversely to its conveying direction are connected each to its two side walls.

8. A drive device for a screening body of a screening machine, the drive device comprising:

a drive motor;

a synchronous transmission operatively connected to said drive motor, said synchronous transmission having a first output shaft and a second output shaft rotating in pairs in opposite directions at the same rotation speed with respect to one another;

a drive motor and synchronous transmission support, the drive motor and the synchronous transmission being mounted in a stationary manner on the drive motor and synchronous transmission support for supporting the drive motor and synchronous transmission separately from the screening body alongside the screening body so as to not oscillate with the screening body;

a first single horizontal shaft associated with said first output shaft;

a second single horizontal shaft associated with said second output shaft and arranged with an axis parallel to the axis of the adjacent first horizontal shaft and transversely with respect to the conveying direction of the screening body;

first unbalance elements supported on said first single horizontal shaft and arranged in the horizontal direction between side walls of the screening body;

second unbalance elements supported on said second single horizontal shaft and arranged in the horizontal direction between the side walls of the screening body;

a first rotationally rigid universally jointed shaft connecting said first horizontal shaft to said first output shaft;

a second rotationally rigid universally jointed shaft connecting said second horizontal shaft a cross member connected to the side walls of the screening body;

bearing elements, each horizontal shaft being supported by the bearing elements on the cross member, wherein the unbalance elements are arranged exclusively directly on the horizontal shafts, the bearing elements are arranged exclusively on the horizontal shafts in the axial direction of the shafts between the unbalance elements, and the bearing elements are supported on the cross member which is connected to the side walls, each of the first horizontal shaft and the second horizontal shaft being formed of shaft sections arranged in alternating succession one behind the other and of offset clutches connecting the shaft sections in a rotationally rigid manner, wherein one shaft section together with the unbalance elements and the bearing elements supporting said one shaft section form an unbalance module.

9. A device according to claim 8, wherein the unbalance elements are individually arranged at the shaft sections.

10. A device according to claim 8, wherein several unbalance elements are arranged at one shaft section.

11. A device according to claim 8, wherein the shaft sections of each horizontal shaft are jointly supported by means of bearing elements on one said cross member.

12. A device according to claim 8, further comprising: a casing for each unbalance module, wherein each unbalance module is partly or entirely surrounded by one said casing.

13. A device according to claim 12, wherein the unbalance modules are fixed in exchangeable arrangement at the cross member.

14. A drive device and screening body combination, the combination comprising:

a screening body with side walls;

a drive motor;

a synchronous transmission operatively connected to said drive motor, said synchronous transmission having a first output shaft and a second output shaft rotating in pairs in opposite directions at the same rotation speed with respect to one another;

a drive motor and synchronous transmission support, the drive motor and the synchronous transmission being mounted in a stationary manner on the drive motor and synchronous transmission support for supporting the drive motor and synchronous transmission separately from the screening body alongside the screening body so as to not oscillate with the screening body;

a first single horizontal shaft associated with said first output shaft;

a second single horizontal shaft associated with said second output shaft and arranged with an axis parallel to the axis of the adjacent first horizontal shaft and transversely with respect to the conveying direction of the screening body;

first unbalance elements supported on said first single horizontal shaft and arranged in the horizontal direction between side walls of the screening body;

second unbalance elements supported on said second single horizontal shaft and arranged in the horizontal direction between the side walls of the screening body;

a first rotationally rigid universally jointed shaft connecting said first horizontal shaft to said first output shaft;

a second rotationally rigid universally jointed shaft connecting said second horizontal shaft to said second output shaft;

a cross member connected to the side walls of the screening body;

bearing elements, each horizontal shaft being supported by the bearing elements on the cross member, wherein the unbalance elements are arranged exclusively directly on the horizontal shafts, the bearing elements are arranged exclusively on the horizontal shafts in the axial direction of the shafts between the unbalance elements, and the bearing elements are supported on the cross member which is connected to the side walls, each of the first horizontal shaft and the second horizontal shaft being formed of shaft sections arranged in alternating succession one behind the other and of offset clutches connecting the shaft sections in a rotationally rigid manner, wherein one shaft section together with the unbalance elements and the bearing elements supporting said one shaft section form an unbalance module.

15. A combination according to claim 14, further comprising: casings wherein:

the shaft sections of each horizontal shaft are jointly supported by means of bearing elements on one said cross member;

and each unbalance module is partly or entirely surrounded by one of said casings.

* * * * *